US006059019A

United States Patent [19]

Brost et al.

[11] Patent Number: 6,059,019

[45] Date of Patent: May 9, 2000

[54] HEAT EXCHANGER ASSEMBLY WITH MODULAR SUPPORT BRACKETS

[75] Inventors: Viktor Brost, Aichtal; Klaus Kalbacher, Rangendingen; Karl Schütterle, Waldorfhäslach; Winfrid Eckerskorn, Ottobrunn; Axel Temmesfeld, Raubling; Manfred Schatz, Münich, all of Germany

[73] Assignees: Modine Manufacturing Company, Racine, Wis.; Bayerische Motoren Werke, Munich, Germany

[21] Appl. No.: 09/122,552

[22] Filed: Jul. 24, 1998

[30] Foreign Application Priority Data

Jul. 25, 1997 [DE] Germany ..... 197 31 999

[51] Int. Cl.[7] ..... F28F 9/007

[52] U.S. Cl. ..... 165/67; 165/140; 123/41.51; 180/68.4

[58] Field of Search ..... 165/67, 140, 144; 180/68.4; 123/41.51

[56] References Cited

U.S. PATENT DOCUMENTS

| | | | |
|---|---|---|---|
| 2,037,845 | 4/1936 | Young | 165/144 X |
| 4,137,982 | 2/1979 | Crews et al. | 180/68.4 |
| 4,757,858 | 7/1988 | Miller et al. | 180/68.4 X |
| 4,997,033 | 3/1991 | Ghiani et al. | 165/67 |
| 5,271,473 | 12/1993 | Ikeda et al. . | |
| 5,558,310 | 9/1996 | Furuie et al. . | |

FOREIGN PATENT DOCUMENTS

| | | | |
|---|---|---|---|
| 3903199 | 4/1990 | Germany . | |
| 9114734 | 3/1992 | Germany . | |
| 4039490 | 6/1992 | Germany . | |
| 4243204 | 6/1994 | Germany . | |
| 4244039 | 7/1994 | Germany . | |
| 19602186 | 5/1997 | Germany . | |
| 19547618 | 6/1997 | Germany . | |
| 3121931 | 5/1991 | Japan . | |
| 692150 | 4/1994 | Japan . | |
| 2262600 | 6/1993 | United Kingdom | 165/140 |

*Primary Examiner*—Leonard Leo
*Attorney, Agent, or Firm*—Wood, Phillips, VanSanten, Clark & Mortimer

[57] ABSTRACT

A heat exchanger assembly is provided attachable to a frame of a vehicle. The heat exchanger assembly includes first and second support brackets attachable to a frame of a vehicle so as to define a mounting space therebetween having closed sides in two facing planes, the first and second support brackets each having a surface thereon transverse to the planes. The heat exchanger assembly also includes a first heat exchanger disposed within the mounting space, the first heat exchanger supported on the surfaces of the first and second brackets and releasably secured to the first and second support brackets. The heat exchanger further includes a second heat exchanger disposed within the mounting space, the second heat exchanger supported on the surfaces of the first and second brackets and releasably secured to the first and second support brackets separately from the first heat exchanger.

20 Claims, 5 Drawing Sheets

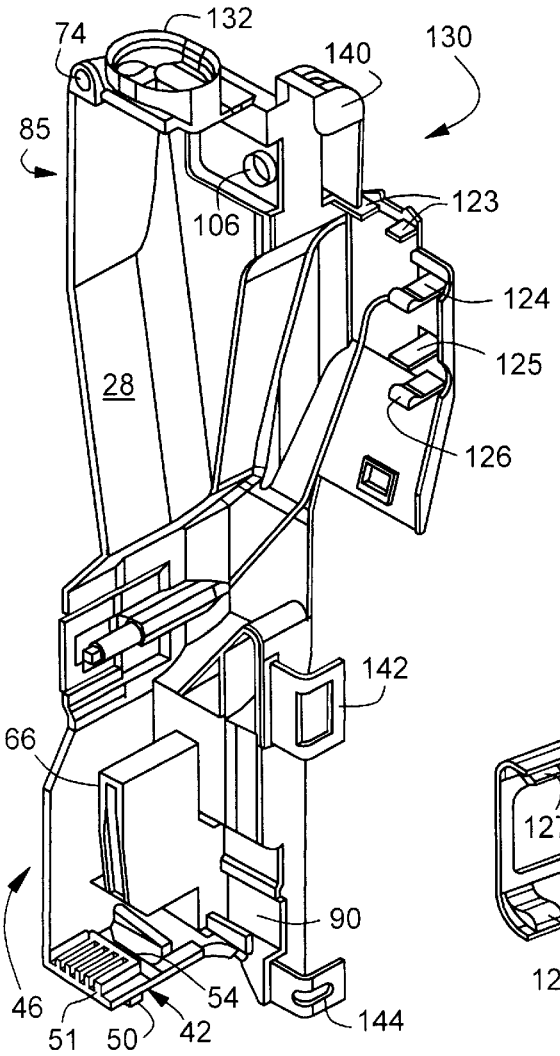
FIG. 2
FIG. 3
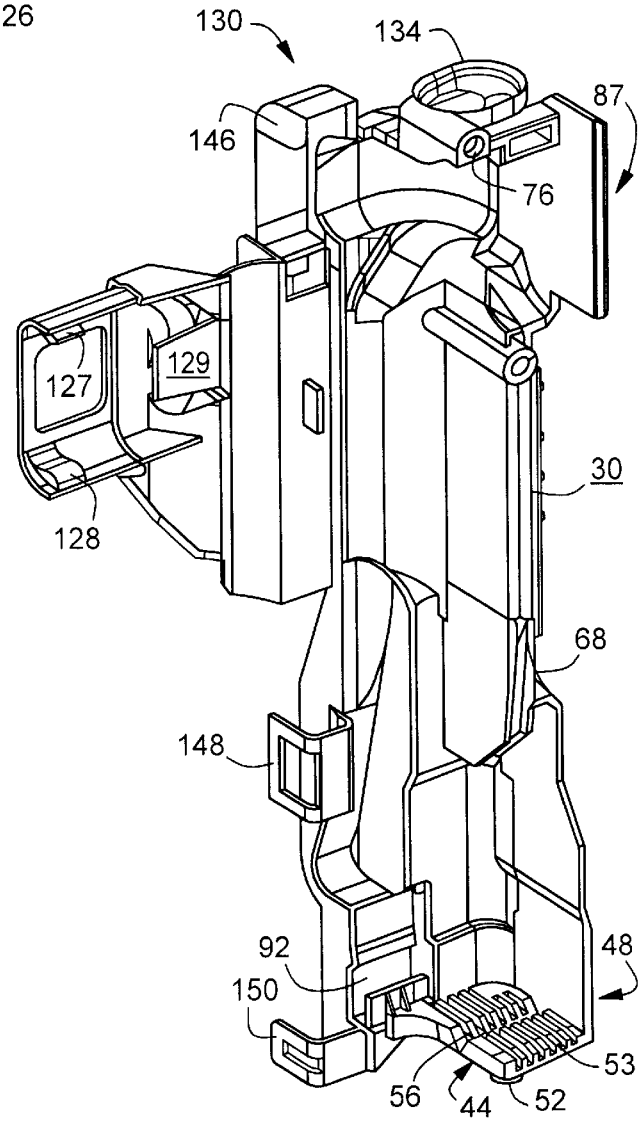

20
85
130
74
132
140
110
106
102
136
114
118
98
26
91
66
146
130
104
76
28
134
46
87
51
90
152
54
94
154
100
30
93
96
24
53
48
52

HEAT EXCHANGER ASSEMBLY WITH MODULAR SUPPORT BRACKETS

FIELD OF THE INVENTION

The present invention is directed to a heat exchanger assembly, and in particular a heat exchanger assembly with modular support brackets.

BACKGROUND OF THE INVENTION

It is known in the art to assemble two or more heat exchangers as a unit for installation in a vehicle. For example, German Patent No. 39 03 199 shows a heat exchanger assembly including a radiator, a charge air cooler, and an oil cooler. The charge air cooler and the oil cooler are attached to one side of the radiator, which in turn is attachable to a frame of a vehicle. Similarly, in German laid-open application 42 44 039, a charge air cooler, an equalization vessel and an oil cooler are attached to a radiator which is attachable to a frame of a vehicle. Moreover, German laid-open application 40 39 490 shows a radiator secured to a frame of a vehicle and a condenser attached to the radiator in an intermediate space between a fan hood and the radiator.

Rather than attaching the radiator and associated heat exchangers directly to a frame of a vehicle, it is also known in the art to mount support brackets on the frame to which the radiator and associated heat exchangers are attached. German Patent No. 196 02 186 C1 shows in FIG. 2 a heat exchanger support structure 25 having a horizontal floor section 26 and a vertical wall section 27. The combination of a radiator 11 and a condenser 12 (FIG. 4) is attached to the side wall 27.

These devices all have a common disadvantage in that it may be necessary to remove all of the associated heat exchangers from the radiator to service the radiator. Further, these heat exchanger assemblies are generally very bulky, which may cause problems in automotive applications where space is at a premium because of the need to streamline the vehicle to improve aesthetics and fuel economy.

It is therefore an object of the invention to provide a heat exchanger assembly which is easy to service and offers the possibility of replacing an individual heat exchanger without having to disassemble the entire assembly.

It is a further object of the invention to provide a heat exchanger assembly which has a space-saving construction.

SUMMARY OF THE INVENTION

According to an aspect of the present invention, a heat exchanger assembly is provided attachable to a frame of a vehicle. The heat exchanger assembly includes first and second support brackets attachable to a frame of a vehicle so as to define a mounting space therebetween having closed sides in two facing planes, the first and second support brackets each having a surface thereon transverse to the planes. The heat exchanger assembly also includes a first heat exchanger disposed within the mounting space, the first heat exchanger supported on the surfaces of the first and second brackets and releasably secured to the first and second support brackets. The heat exchanger further includes a second heat exchanger disposed within the mounting space, the second heat exchanger supported on the surfaces of the first and second brackets and releasably secured to the first and second support brackets separately from the first heat exchanger.

BRIEF DESCRIPTION OF THE DRAWINGS

FIG. 2 is an enlarged, perspective view of the left support bracket of the heat exchanger assembly of FIG. 1;

FIG. 3 is an enlarged, perspective view of the right support bracket of the heat exchanger assembly of FIG. 1;

DETAILED DESCRIPTION OF THE PREFERRED EMBODIMENTS

Figure 1:
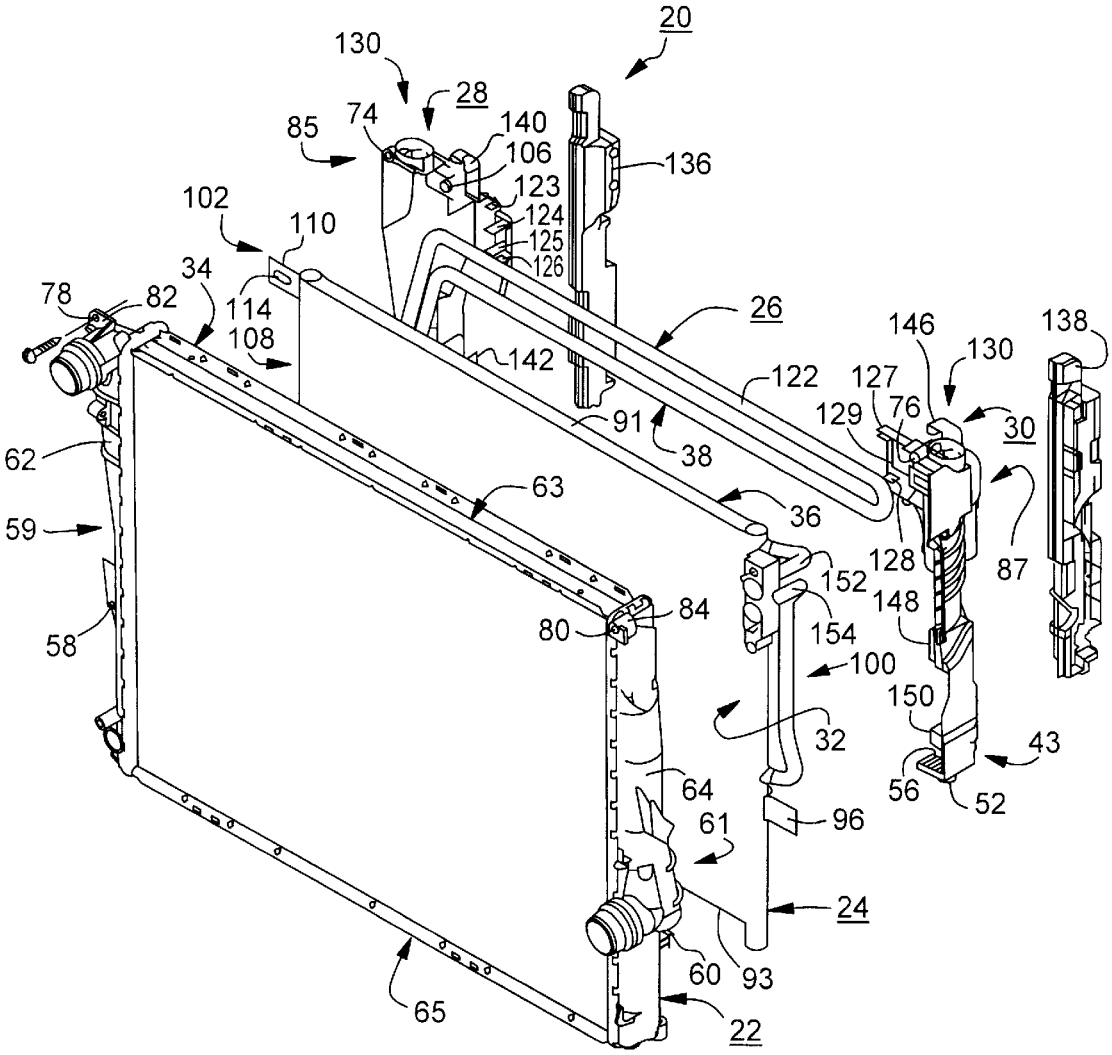
FIG. 1 is an exploded, perspective view of a heat exchanger assembly according to the present invention, including a radiator, a condenser, an oil cooler, and left and right support brackets.

A heat exchanger assembly 20 according to the present invention is shown in FIG. 1. The heat exchanger assembly 20 includes a radiator 22, a condenser 24, and an oil cooler 26. The heat exchanger assembly 20 has left and right support brackets 28, 30 which are used to secure the radiator 22, the condenser 24, and the oil cooler 26 together, and to secure the heat exchanger assembly 20 to a frame of a vehicle. The radiator 22, the condenser 24, and the oil cooler 26 are connected to brackets 28, 30 with the condenser 24 generally disposed with the first side 32 facing a first side 34 of the radiator 22, and a second side 36 facing a first side 38 of the oil cooler 26.

To mount the heat exchanger assembly 20 to a vehicle, either the radiator 22 or the condenser 24 is attached to the brackets 28, 30 to form a subassembly. The remaining heat exchangers 22, 24, 26 are then attached to the subassembly. The brackets 28, 30 are then attached to the frame of the vehicle.

Figure 4:
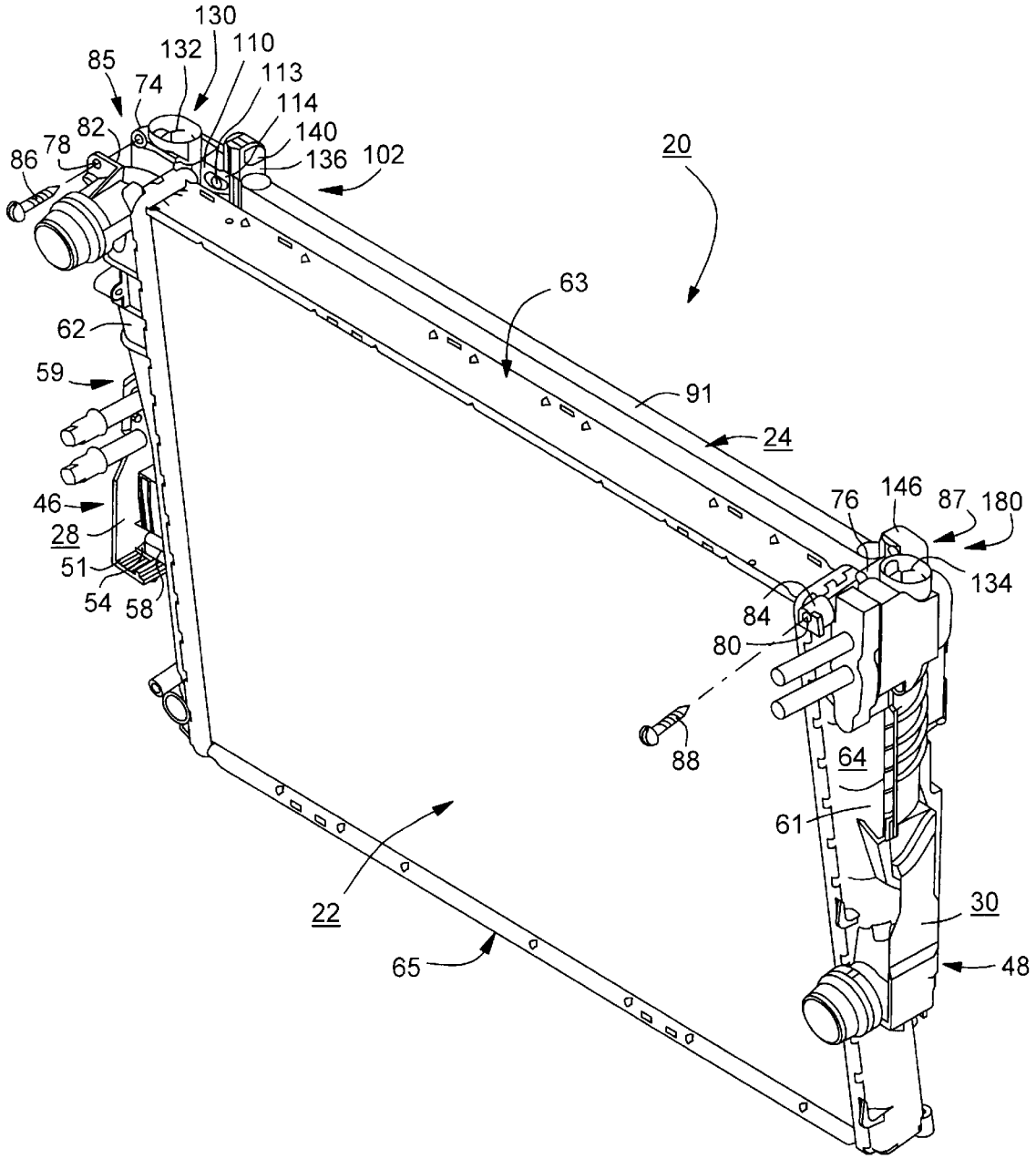
FIG. 4 is a perspective view of the heat exchanger assembly of FIG. 1, as assembled.
Figure 5:
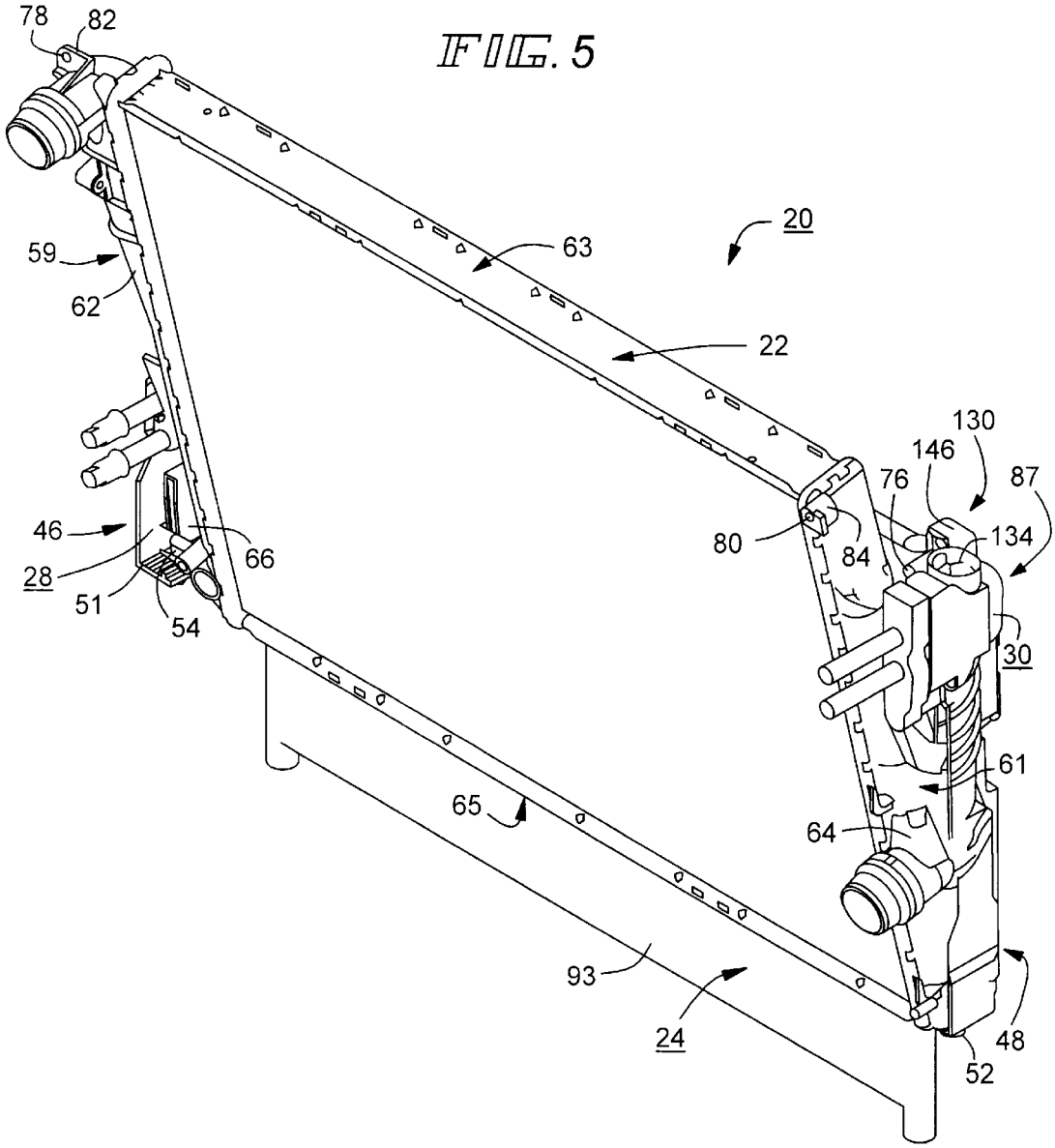
FIG. 5 is a perspective view of the heat exchanger assembly of FIG. 1 with the radiator partially removed.
Figure 6:
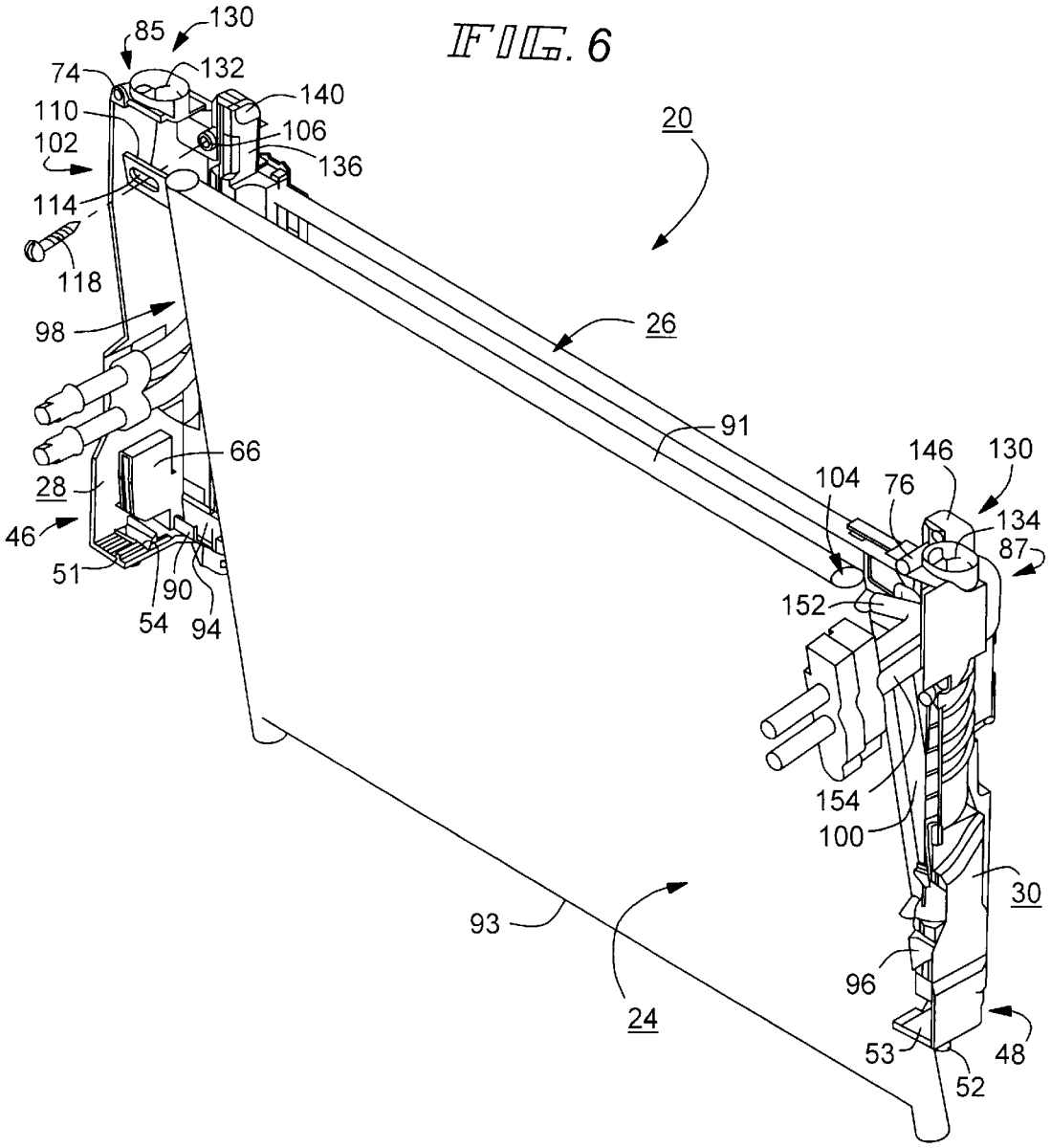
FIG. 6 is a perspective view of the heat exchanger assembly of FIG. 1 with the radiator removed and the condenser partially removed.

To remove an individual heat exchanger from the heat exchanger assembly 20, it is not necessary to remove the assembly 20 from the vehicle, or disassemble all of the heat exchangers 22, 24, 26 from the brackets 28, 30. Instead, an individual heat exchanger, for example the radiator 22, can be removed without disassembling the other heat exchangers from the brackets 28, 30 (as shown in FIGS. 4–6, respectively). This is accomplished by detaching the fasteners used to secure the heat exchanger to the brackets 28, 30, and separating the heat exchanger from the brackets 28, 30.

The support brackets 28, 30 are now discussed in greater detail with reference to FIGS. 2 and 3. Each bracket 28, 30 has a branched geometrical structure, and can be produced very simply from, for example, plastic in an injection-molding process. While the brackets 28, 30 shown are not mirror images of each other, the brackets 28, 30 could be so formed.

Each of the brackets 28, 30 has a rubber pad 42, 44 disposed at a lower end 46, 48 thereof. Each pad 42, 44 defines a pin 50, 52 which is used to mount the assembly 20 to the vehicle frame. The rubber pads 42, 44 also serve to dampen the vibrations caused by the vehicle. The rubber pads 42, 44 may be attached to the brackets 28, 30 using any conventional joining method.

The lower ends 46, 48 of the brackets 28 also have surfaces 51, 53 with V-shaped recesses 54, 56 formed therein. The V-shaped recesses 54, 56 define nesting sites for receiving aligned protrusions 58, 60 attached to sides 59, 61 of the radiator 22, specifically attached to header/tank assemblies 62, 64 of the radiator 22. The protrusions 58, 60 are disposed intermediate to an upper edge 63 and a lower edge 65 of the radiator 22.

These recesses 54, 56 and protrusions 58, 60 aid in positioning the radiator 22 relative to the remainder of the heat exchanger assembly 20. The V-shaped recesses 54, 56 of the brackets 28, 30 and the protrusions 58, 60 on the radiator 22 also cooperate in such a way that the radiator 22 can be swiveled out from the heat exchanger assembly 20 at a relatively large angle for assembly and disassembly.

Easy installation of the radiator into the brackets 28, 30 is also aided by guides 66, 68 on the brackets 28, 30. During installation, the radiator 22 is abutted against these guides 66, 68, and then slid along the guides 66, 68 into its position on the brackets 28, 30. The guides 66, 68 are particularly helpful because with the heat exchanger assembly 20 attached to the vehicle, it is often difficult to see whether the radiator 22 has been properly mounted on the brackets 28, 30.

As seen in FIG. 4, to secure the radiator 22 to the brackets 28, 30, threaded bores 74, 76 are provided in the brackets 28, 30 and slots 78, 80 are provided in tabs 82, 84 attached to the header/tank assemblies 62, 64 of the radiator 22. Screws 86, 88 are disposed through the slots 78, 80 and into the bores 74, 76 to secure the radiator 22 to the brackets 28, 30 at upper ends 85, 87 thereof.

The surfaces 51, 53 of the brackets 28, 30 also have U-shaped recesses 90, 92 formed therein. The U-shaped recesses 90, 92 define nesting sites for receiving protrusions in the form of aligned mounting tabs 94, 96 (see FIGS. 1 and 6) attached to the left and right sides 98, 100 of the condenser 24. The mounting tabs 94, 96 are disposed intermediate to an upper edge 91 and a lower edge 93 of the condenser 24.

The U-shaped recesses 90, 92 and the mounting tabs 94, 96 of the condenser 24 cooperate to position the condenser 24 relative to the remainder of the heat exchanger assembly 20. Additionally, the U-shaped recesses 90, 92 and the mounting tabs 94, 96 cooperate in such a way that the condenser 24 can be swiveled out from the heat exchanger assembly 20 at a relatively large angle for assembly and disassembly.

Here also, means have been provided for fastening the upper end 102 of the condenser 24 to the upper end 85 of the brackets 28, 30. Specifically, the bracket 28 has a threaded bore 106, and the condenser has a mounting tab 110 attached thereto with a slot 114 formed therethrough. A fastener 118, such as a screw, for example, is disposed through the slot 114, and into the bore 106, to secure the condenser 24 to the bracket 28 at the upper end 85 thereof.

The oil cooler 26 (FIG. 1) is attached to the brackets 28, 30 in the following manner. The oil cooler 26 has a tubular pipe 122 which is received between resilient tabs 123, 124, 125, 126, 127, 128 and 129 (FIGS. 2 and 3). Specifically, the tubular pipe 122 is snap-fitted into the tabs 123, 124, 125, 126, 127, 128, 129 which are integrally formed with the brackets 28, 30.

A mechanism 130 is also provided for removably securing the heat exchanger assembly 20 to the frame of a vehicle. Specifically, mounts 132, 134 are provided at the upper ends 85, 87 of the brackets 28, 30. These mounts 132, 134 are generally shaped like pots, as shown in FIGS. 2 and 3. These mounts 132, 134 would be fastened to the frame of the vehicle in a conventional manner, as by receiving rubber grommets mounted to a frame member (not shown). Optionally, as one of ordinary skill in the art would recognize, holes could also have been provided through which fasteners, e.g. screws, could have been introduced to secure the heat exchanger assembly 20 to the frame of the vehicle.

It may also be desirable to provide foam-like sealing elements 136, 138 to further direct the stream of cooling air which flows across the heat exchanger assembly 20, and so prevent the cooling air stream from partially bypassing the heat exchanger assembly 20, thereby degrading the performance of the heat exchangers 22, 24, 26 which are a part of the heat exchanger assembly 20. Hook-like tabs 140, 142, 144 are provided on the bracket 28, and hook-like tabs 146, 148, 150 are provided on the bracket 30 to attach the sealing elements 136, 138 to the brackets 28, 30. In particular, the sealing elements 136, 138 are placed within these tabs 140, 142, 144, 146, 148, 150 to tightly fit the sealing elements 136, 138 against the tubular pipe 122 of the oil cooler 26 and the inlet and outlet pipes 152, 154 of the condenser 24. To this end, the sealing elements 136, 138 are provided with cut-outs in order to maintain a tight fit of the sealing elements 136, 138 against the tubular pipe 122 and the inlet and outlet pipes 152, 154.

To install the heat exchanger assembly 20 into a vehicle, the heat exchangers 22, 24, 26 are first mounted on the brackets 28, 30. For example, the oil cooler 26 may be placed in the tabs 123, 124, 125, 126, 127, 128, 129 so as to secure the oil cooler 26 to the brackets 28, 30. The condenser 24 can then be slipped between the brackets 28, 30 so that the tabs 94, 96 rest against the nesting sites defined by the U-shaped recesses 90, 92. To secure the condenser in place, the screw 118 is disposed through the slot 114 and into the bore 106 of the left bracket 28. The radiator 22 is then placed against the guides 66, 68 and moved therealong such that the protrusions 58, 60 of the radiator 22 are seated within the nesting surfaces defined by the V-shaped recesses 54, 56. The fasteners 86, 88 are disposed through the slots 78, 80 and into the bores 74, 76 to secure the radiator 22 to the brackets 28, 30. The sealing elements 136, 138 are placed within the tabs 140, 142, 144, 146, 148, 150, and the heat exchanger assembly 20 is ready for installation into the vehicle.

If it becomes necessary to service one or more of the heat exchangers 22, 24, 26 once the heat exchanger assembly 20 is installed in a vehicle, it is not necessary to detach the entire heat exchanger assembly 20 from the vehicle. Furthermore, it is not necessary to disassemble the entire heat exchanger assembly 20 in order to service a single heat exchanger 22, 24, 26, because each of the heat exchangers 22, 24, 26 is individually mounted to the brackets 28, 30.

Specifically, with reference to FIGS. 4–6, it can be seen that to remove the radiator 22, all that is required is that the screws 86, 88 first be removed from the bores 74, 76 and slots 78, 80. Having removed these fasteners 86, 88, the radiator 22 can be swiveled outwardly and upwardly from the remainder of the heat exchanger assembly 20.

Similarly, if it is necessary to remove the condenser 24, the screw 118 is first removed from the bore 106 and the slot 114. With the fastener 118 removed, the condenser 24 can be swiveled slightly forward with the radiator 22 still in place, and then removed upwardly so that the tabs 94, 96 are no longer seated within the nesting surfaces provided by the U-shaped recesses 90, 92.

While the screws 86, 88, 118 are used to fasten the radiator 22 and the condenser 24 to the brackets 28, 30, use of such fasteners may be considered to be disadvantageous in some cases. Therefore, resilient tabs, such as the tabs 123, 124, 125, 126, 127, 128, 129 can also be used with radiator 22 and the condenser 24 to secure the radiator 22 and the condenser 24 to the brackets 28, 30. Use of such clamps not only allows for safe and rapid installation of the heat exchangers, but would also provide some degree of dampening protection against the vibrations generated by the vehicle.

Accordingly, a device assembled according to the present invention allows for numerous advantages. For example, by providing separate mountings for the heat exchangers 22, 24, 26, installation and removal of the heat exchangers 22, 24, 26 may be simplified. Specifically, it is not necessary to remove all of the heat exchangers 22, 24, 26 when servicing any one of the heat exchangers 22, 24, 26. Additionally, it is not necessary to open the cooling circuits with which the other heat exchangers 22, 24, 26 are associated when servicing any one of the heat exchangers 22, 24, 26. Moreover, the assembly 20 occupies less space than in conventional systems, which is significantly advantageous in allowing for the overall shape and size of the vehicle in which it is installed to be decreased.

Still other aspects, objects, and advantages of the present invention can be obtained from a study of the specification, the drawings, and the appended claims.

We claim:

1. A heat exchanger assembly attachable to a frame of a vehicle comprising:

first and second support brackets attachable to a frame of a vehicle so as to define a mounting space therebetween having closed sides in two facing planes, the first and second support brackets each having a surface thereon transverse to the planes;

a first heat exchanger disposed within the mounting space, the first heat exchanger having face and sides supported on the surfaces of the first and second brackets and releasably secured to the first and second support brackets; and a second heat exchanger disposed within the mounting space, the second heat exchanger having a face and sides supported on the surfaces of the first and second brackets and releasably secured to the first and second support brackets separately from the first heat exchanger;

said first and second heat exchangers being in face to face relation.

2. A heat exchanger assembly attachable to a frame of a vehicle comprising:

first and second support brackets attachable to a frame of a vehicle so as to define a mounting space therebetween having closed sides in two facing planes, the first and second support brackets each having a surface thereon transverse to the planes;

a first heat exchanger disposed within the mounting spaces the first heat exchanger supported on the surfaces of the first and second brackets and releasably secured to the first and second support brackets; and a second heat exchanger disposed within the mounting space, the second heat exchanger supported on the surfaces of the first and second brackets and releasably secured to the first and second support brackets separately from the first heat exchanger;

said first heat exchanger having a first side facing one of the closed sides of the mounting space and a second side facing the other of the closed sides of the mounting space, each of the first and second sides having first and second edges and a protrusion disposed intermediately to the first and second edges, abutting the surface of one of the first and second brackets, and aligned with the protrusion on the other side of the first heat exchanger along a first axis.

3. The heat exchanger assembly according to claim 2, wherein the surfaces of the first and second brackets each have a recess therein, each recess having one of the protrusions seated therein whereby the first heat exchanger may be pivoted relative to the first and second brackets about the first axis.

4. The heat exchanger assembly according to claim 3, wherein the the first and second brackets each have a guide attached thereto, the first heat exchanger abutted against the guides to position the first heat exchanger relative to the first and second brackets so as to be supported on the surfaces of the first and second brackets with the protrusions seated within the recesses.

5. The heat exchanger assembly according to claim 2, wherein the first heat exchanger has first and second header/tank assemblies disposed at the first and second sides of the first heat exchanger, the protrusion of the first side attached to the first header/tank assembly and the protrusion of the second side attached to the second header/tank assembly.

6. The heat exchanger assembly according to claim 2, wherein the first heat exchanger includes a tab attached to the first side and a tab attached to the second side, each tab defining one of the protrusions.

7. The heat exchanger assembly according to claim 2, further comprising fasteners attached to the first heat exchanger and the first and second brackets to secure the first heat exchanger to the first and second brackets.

8. The heat exchanger assembly according to claim 2, wherein the first and second brackets each have a bore therein and the first heat exchanger has first and second tabs attached thereto with slots therein, the slots aligned with the bores of the first and second brackets with the first heat exchanger supported on the surfaces of the first and second brackets, and further comprising two fasteners, each fastener passed through the slot of one of the first and second tabs and secured in the bore of one of the first and second brackets.

9. The heat exchanger assembly according to claim 8, wherein the bores are threaded and the fasteners are screws.

10. The heat exchanger assembly according to claim 8, wherein the first bracket has another bore therein and the second heat exchanger has a first tab attached thereto with a slot therein, the slot aligned with the other bore of the first bracket with the second heat exchanger supported on the surfaces of the first and second brackets, and further comprising a third fastener, the fastener passed through the slot of the first tab and secured in the bore of the first bracket.

11. The heat exchanger assembly according to claim 2, further comprising a third heat exchanger supported on and secured to the first and second brackets separately from the first and second heat exchangers, the third heat exchanger having a tube and the first and second brackets having elastic tabs attached thereto with surfaces which support the tube thereon and secure the tube therebetween.

12. A heat exchanger assembly attachable to a frame of a vehicle comprising:

first and second support brackets attachable to a frame of a vehicle so as to define a mounting space therebetween having closed sides in two facing planes the first and second support brackets each having a surface thereon transverse to the planes;

a first heat exchanger disposed within the mounting space, the first heat exchanger supported on the surfaces of the first and second brackets and releasably secured to the first and second support brackets; and a second heat exchanger disposed within the mounting space, the second heat exchanger supported on the surfaces of the first and second brackets and releasably secured to the first and second support brackets separately from the first heat exchanger;

said first and second brackets each having a guide attached thereto, the first heat exchanger being abutted against the guides to position the first heat exchanger relative to the first and second brackets so as to be supported on the surfaces of the first and second brackets.

13. A heat exchanger assembly attachable to a frame of a vehicle comprising:

first and second support brackets attachable to a frame of a vehicle so as to define a mounting space therebetween having closed sides in two facing planes, the first and second support brackets each having a surface thereon transverse to the planes;

a first heat exchanger disposed within the mounting space the first heat exchanger supported on the surfaces of the first and second brackets and releasably secured to the first and second support brackets; and a second heat exchanger disposed within the mounting space, the second heat exchanger supported on the surfaces of the first and second brackets and releasably secured to the first and second support brackets separately from the first heat exchanger;

said first bracket having a projection attached thereto to define a space between a surface of the projection and a surface of the first bracket, and further comprising a first sealing element to direct air flow through the heat exchanger assembly across the first and second heat exchangers, the first sealing element disposed in the space between the surface of the projection and the surface of the first bracket to secure the first sealing element to the first bracket.

14. The heat exchanger assembly according to claim 13, wherein the second bracket has a projection attached thereto to define a space between a surface of the projection and a surface of the second bracket, and further comprising a second sealing element to direct air flow through the heat exchanger assembly across the first and second heat exchangers, the second sealing element disposed in the space between the surface of the projection and the surface of the second bracket to secure the second sealing element to the second bracket.

15. The heat exchanger assembly according to claim 13, wherein the first and second sealing elements abut the second heat exchanger.

16. The heat exchanger assembly according to claim 15, wherein the second heat exchanger has inlet and outlet pipes, and one of the first and second sealing elements has a cut-out which conforms to the inlet and outlet pipes.

17. A heat exchanger assembly attachable to a frame of a vehicle comprising:

first and second support vertically extending brackets attachable to a frame of a vehicle so as to define a rectangularly-shaped mounting space therebetween having closed sides in two facing, parallel planes, the first and second support brackets each having a surface thereon orthogonal to the planes;

a first rectangularly-shaped heat exchanger disposed within the mounting space, the first heat exchanger having a face and first and second sides parallel to the sides of the first and second brackets, each of the first and second sides having a protrusion extending orthogonally therefrom and supported on one of the surfaces of the first and second brackets, and being releasably secured to the first and second support brackets; and a second rectangularly-shaped heat exchanger disposed within the mounting space, the second heat exchanger having a face and first and second sides parallel to the sides of the second brackets, each of the first and second sides having a protrusion extending orthogonally therefrom and supported on one of the surfaces of the first and second brackets, and releasably secured to the first and second support brackets separately from the first heat exchanger;

said first and second heat exchangers being in face to face relation.

18. A heat exchanger assembly attachable to a frame of a vehicle comprising:

first and second unitary support brackets attach able to a frame of a vehicle so as to define a mounting space therebetween having closed sides in two facing first planes and open sides in two additional facing, panes so that said mounting space is a rectangular mounting space, the first and second support brackets each having a surface thereon transverse to the planes;

a first rectangular heat exchanger disposed within the mounting space and having form sides extending to corresponding ones of said planes, the first heat exchanger supported on said transverse surfaces of the first and second brackets and secured to the first and second support brackets to connect the first and second brackets together; and a second rectangular heat exchanger disposed within the mounting space having form sides extending to corresponding ones of said planes, the second heat exchanger supported on said transverse surfaces of the first and second brackets and secured to the first and second support brackets separately from the first heat exchanger to separately connect the first and second brackets together.

19. The heat exchanger assembly according to claim 18, wherein the surface of the first bracket has a recess therein the first heat exchanger has a first protrusion attached thereto seated in the recess of the first bracket, the first heat exchanger being secured to the first bracket at a location spaced from the surface of the first bracket to secure the first protrusion in the recess of the first bracket;

said surface of the second bracket having a recess therein, the first heat exchanger having a second protrusion attached thereto seated in the recess of the second bracket, the first heat exchanger being secured to the second bracket at a location spaced from the surface of the second bracket to secure the second protrusion in the recess of the second bracket.

20. A heat exchanger assembly attachable to a frame of a vehicle comprising:

first and second unitary support brackets attachable to a frame of a vehicle so as to define a mounting space therebetween having closed sides in two facing planes the first and second support brackets each having a surface thereon transverse to the planes;

a first heat exchanger disposed within the mounting space, the first heat exchanger supported on the surfaces of the first and second brackets and secured to the first and second support brackets to connect the first and second brackets together; and a second heat exchanger disposed within the mounting space, the second heat exchanger supported on the surfaces of the first and second brackets and secured to the first and second support brackets separately from the first heat exchanger to separately connect the first and second brackets together;

said surface of the first bracket having a recess therein, the first heat exchanger having a first protrusion attached thereto seated in the recess of the first bracket, the first heat exchanger being secured to the first bracket at a location spaced from the surface of the first bracket to secure the first protrusion in the recess of the first bracket.

* * * * *